US007260868B2

(12) United States Patent
Cheng

(10) Patent No.: US 7,260,868 B2
(45) Date of Patent: Aug. 28, 2007

(54) SIMPLE DUST COLLECTOR

(75) Inventor: Chieh yuan Cheng, Taichung (TW)

(73) Assignee: San Ford Machinery Co., Ltd., Taichung (TW)

( * ) Notice: Subject to any disclaimer, the term of this patent is extended or adjusted under 35 U.S.C. 154(b) by 649 days.

(21) Appl. No.: 10/841,636

(22) Filed: May 10, 2004

(65) Prior Publication Data

US 2005/0246856 A1 Nov. 10, 2005

(51) Int. Cl.
*A47L 9/10* (2006.01)
*A47L 9/12* (2006.01)

(52) U.S. Cl. ..... 15/347; 15/353; 15/327.6; 55/361; 55/372; 55/490

(58) Field of Classification Search ..... 15/314, 15/327.1, 327.2, 327.5, 327.6, 327.7, 347, 15/353; 55/361, 372, 376, 490
See application file for complete search history.

(56) References Cited

U.S. PATENT DOCUMENTS 2,778,441 A * 1/1957 Herriott ..... 55/357
2,905,267 A * 9/1959 Thompson ..... 55/363
3,286,446 A * 11/1966 Reynold et al. ..... 55/357
3,996,640 A * 12/1976 Blue et al. ..... 15/320
4,715,872 A * 12/1987 Snyder ..... 55/315
2006/0156504 A1* 7/2006 Bruneau ..... 15/314

* cited by examiner

*Primary Examiner*—Terrence R. Till
(74) *Attorney, Agent, or Firm*—Troxell Law Office, PLLC

(57) ABSTRACT

A simple dust collector includes a housing, a base plate horizontally separating the interior of the housing to form a motor chamber for fix a motor to rotate a fan covered by a fan cover under the base plate. A sucking passageway and a wind-exhausting hole are formed under the fan cover, and a tube joint is connected with the sucking passageway connected to a dust tube. The plurality of wind outlets are formed in a lower section of the housing and sealed by an airy cloth ring to filter dust from wind. The housing has an opening in a lower side and the opening is fitted with a dust bag for dust carried by the wind generated by the fan from the passageway and swirled by centrifugal force caused by rotation of the fan to fall and be collected in the dust bag.

4 Claims, 5 Drawing Sheets

SIMPLE DUST COLLECTOR

BACKGROUND OF THE INVENTION

1. Field of the Invention

This invention relates to a dust collector, particularly to one having a housing for containing a motor, a fan, and a sucking passageway to minimize the dimensions of the whole dust collector, to smoothen its outer appearance and make it easy and convenient to use.

2. Description of the Prior Art

There are many kinds of industrial dust collectors available, and one of conventional dust collectors disclosed in a Taiwan patent application of No. 86202448 titled "Dust Collector" includes a bottom plate, and a fix post standing upright on the center of the bottom plate, a motor firmly provided on the fix post, a duct collecting chamber formed on the motor, plural inlets and outlets formed in an upper and a lower surface respectively at a proper location, and a fan fixed on a shaft of the motor extending in the dust chamber, and plural dust bags hung at the outlets. Thus, when the motor rotates the fan in the dust chamber, air with dust is sucked through the inlets and then into the dust chamber, and then blown into the dust bag via the outlets.

However, the conventional dust collector has some disadvantages listed below, which should be improved properly.

1. The dimensions of the conventional dust collector are rather large and heavy, directly positioned on the ground, often located in a narrow workplace.

2. The conventional dust collector has comparatively not a few dust bags for a large dust volume, and needs large wind for exhausting dust, and subsequently many materials are required, but is not so suitable for a rather small factory.

3. The fix post, the motor and the dust bags are all exposed, occupying a large space, easily subject to dirt and moisture by the exposed structure, and having not so smooth appearance.

SUMMARY OF THE INVENTION

This invention has been devised to offer a simple dust collector, which has its components all contained in a housing to make it look smooth and neat and to occupy a comparatively small space.

The simple dust collector includes a housing, a base plate horizontally separating the interior of the housing to form a motor chamber in an upper portion of the interior, a motor fixed in the motor chamber and having a shaft to rotate a fan located under the base plate. A sucking passageway and a wind-exhausting hole are respectively provided to communicate with the fan cover, and a tube joint is connected with the sucking passageway to connect with a dust tube. At the same time, a plurality of wind outlets are formed in a lower section of the cylindrical wall of the housing than the wind exhausting hole, and an airy cloth ring is fitted around the wind outlets for filtering dust from air. A dust bag is fitted around an opening formed in a lower side of the housing.

In the simple dust collector according to the invention, the motor, the fan, the sucking passageway, etc. almost all the components are contained in the housing with a cover, and the wind outlets are formed in the vertical cylindrical wall, so one dust gag is needed only to reduce the whole size of the dust collector, taking a small space for installing it, having a clean and neat appearance.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
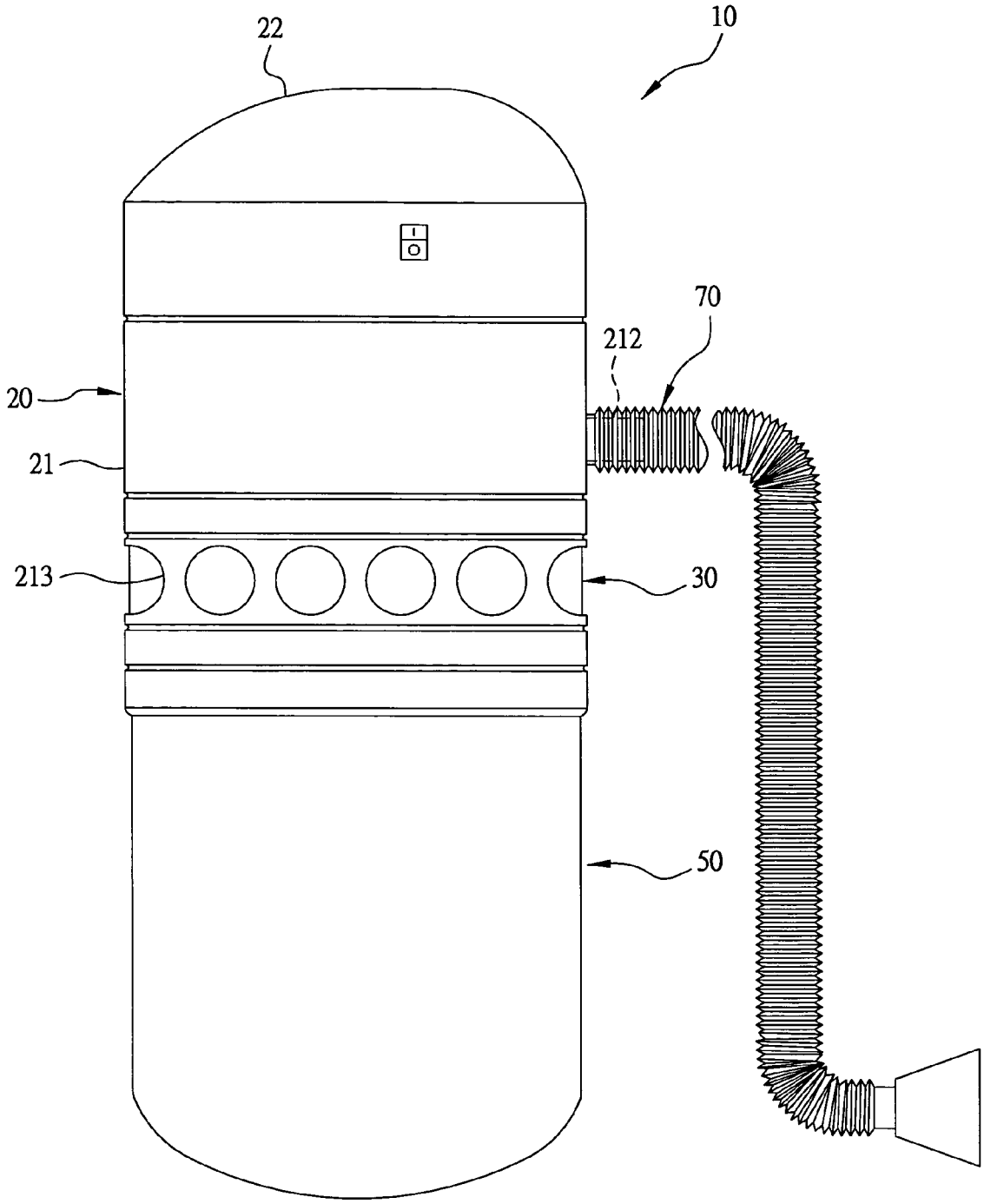
FIG. 1 is a front view of a simple dust collector in the present invention.
Figure 2:
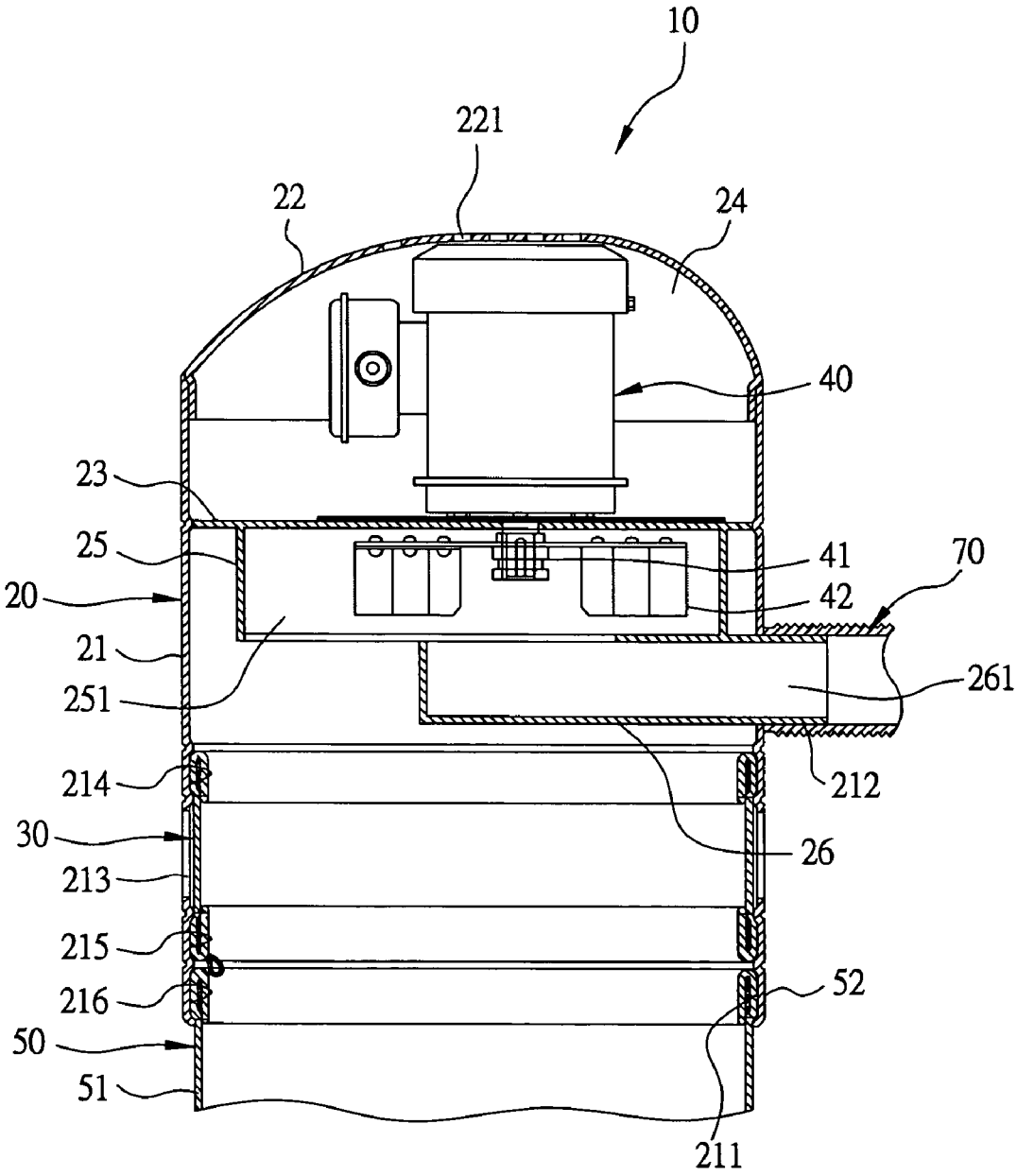
FIG. 2 is a front cross-sectional view of the simple dust collector in the present invention.

A preferred embodiment of a simple dust collector in the present invention, as shown in FIGS. 1 and 2, includes a housing 20, an airy cloth ring 30, a motor 40, a dust bag 50 and a fix unit 60 as main components.

The housing 20 is cylindrical, having a circumferential cylindrical wall 21, a cap 22 sealing an upper side of the cylindrical wall 21 and having a plurality of dispersing holes 221 for heat dispersing, a base plate 23 fixed horizontally in an upper portion of the interior of the housing 20 for separating the interior of the housing 20, a motor chamber 24 formed between the cap and the base plate 23, a fan cover 25 fixed under the lower surface of the base plate 23, a guide tube 26 with a sucking passageway 261 connected with the fan cover 25, and a wind exhausting hole 251 formed in a lower side of the fan cover 25. Further, a tube joint 212 is connected with the other end of the sucking passageway 261 and extending out of the cylindrical wall 21 and then connected with a dust tube 70. A plurality of wind outlets 213 are formed spaced apart in proper intervals in a lower section of the cylindrical wall 21 to communicate with the exterior, a first annular groove 214 is formed in an upper wall defining the wind outlets 213, and a second annular groove 215 is formed in a lower wall defining the wing outlets 213. Further, a third annular groove 216 is formed under the second annular groove 215.

Figure 3:
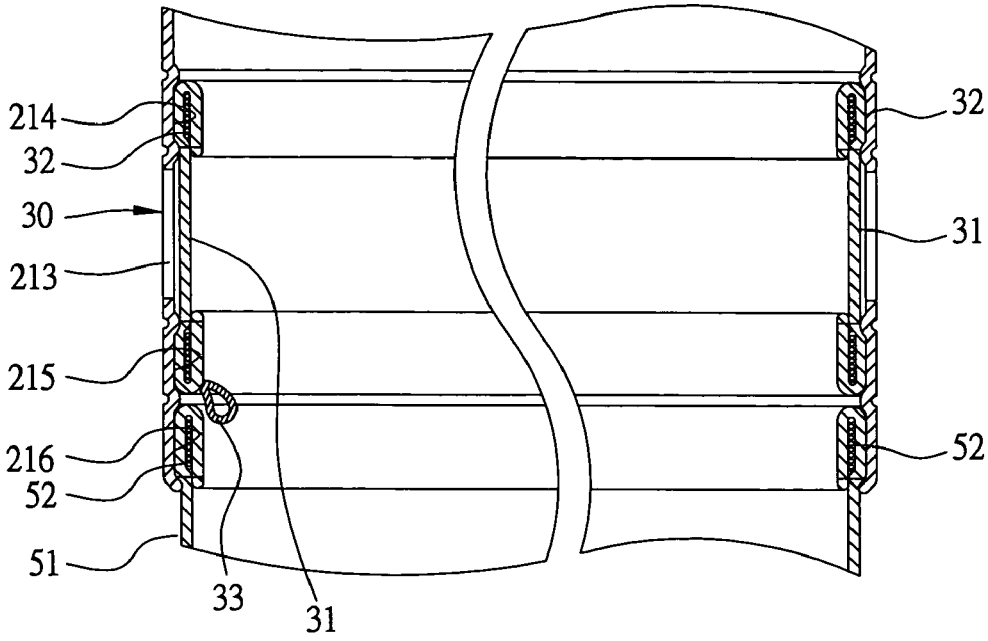
FIG. 3 is a partial cross-sectional view of the simple dust collector in the present invention.
Figure 4:
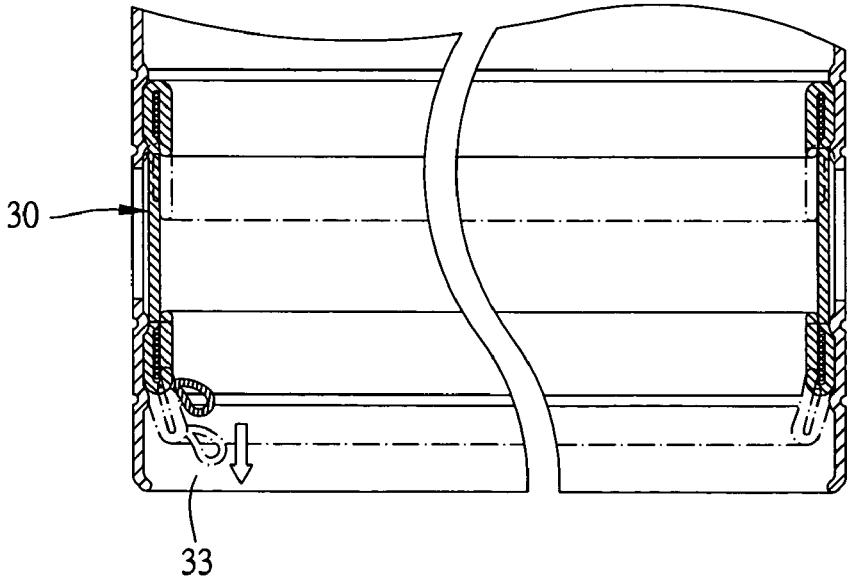
FIG. 4 is a cross-sectional view of an airy cloth ring pulled down in the present invention.

The airy cloth ring 30, as shown in FIG. 3, made of a cloth band 31, with an elastic member 32 wrapped respectively on an upper side and a lower side of the cloth band 31, permitting the airy cloth ring 30 elastically fitting tightly around the first and the second annular groove 214 and 215 of the wind outlets 213. Then dust mixed in air can be intercepted by the airy cloth ring 30 with the air flowing through the cloth ring 30 and then blown out of the wind outlets 213. In addition, a pull ring 33 is shown with the lower section of the airy cloth ring 30, as shown in FIG. 4, so a user can pull the pull ring 33 to take down easily the airy cloth ring 30 off the wind outlets 213.

The motor 40 is fixed firmly on the base plate 23 in the motor chamber 24 of the housing 20, having a shaft 41 extending through the base plate 23 to be connected with and drive a fan 42, which is positioned in the fan cover 25 and rotated by the motor 40 to generate sucking centrifugal force to blow in the sucking passageway 261.

The dust bag 50 has a bag body 51 with a mouth 511 with an elastic strip 52 wrapped thereon, letting the dust bag 50 fitting elastically around the third annular groove 216 of the housing 20 for collecting powder dust falling down through the exhausting hole 251 therein. The dust bag 50 is easily pulled down elastically owing to the elastic strip 52 replaceable with a new one in case of need.

Figure 5:
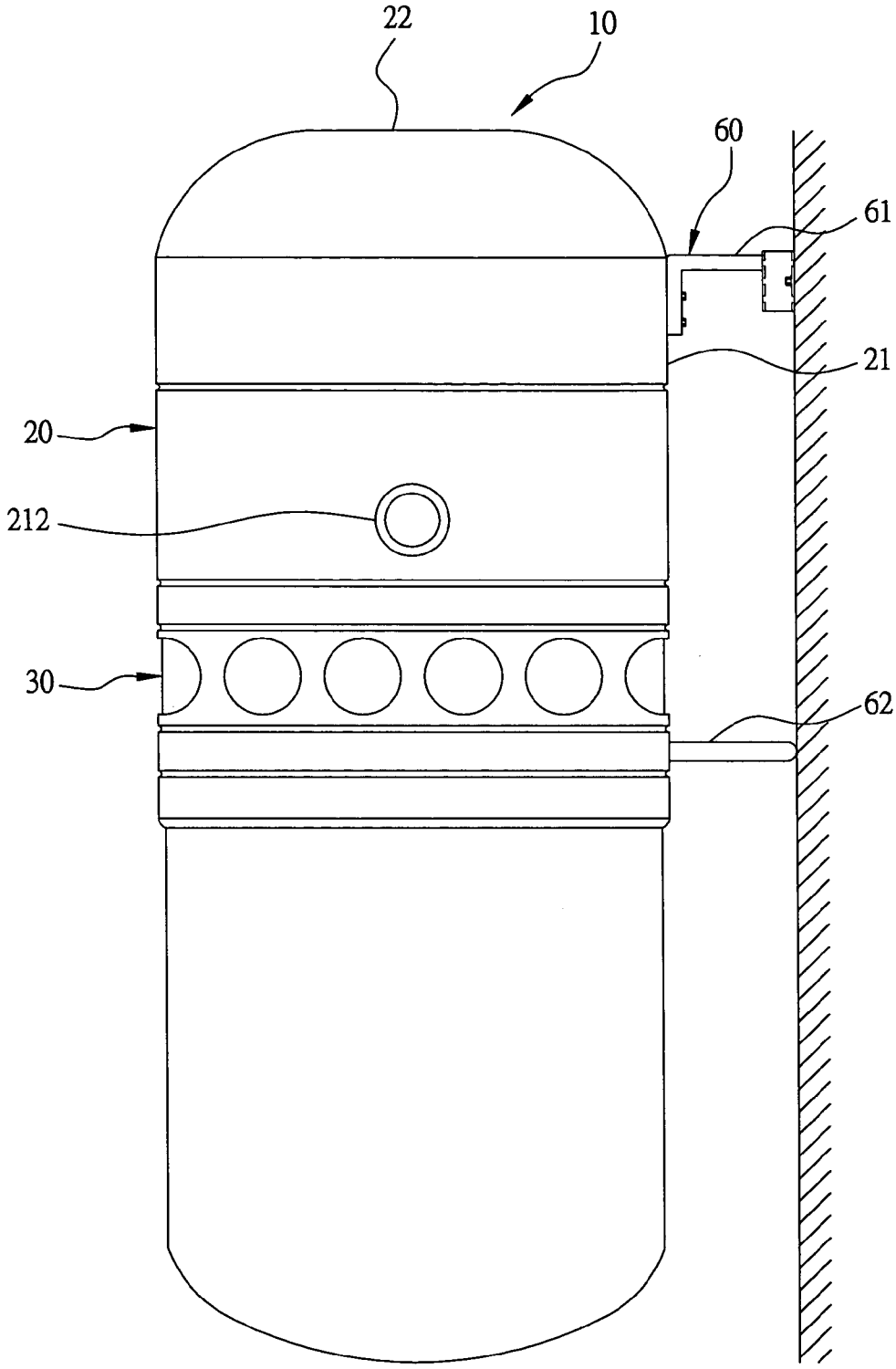
FIG. 5 is a side view of the simple dust collector in the present invention fixed with something such as a vertical wall; and, FIG. 6 is a cross-sectional view of the simple dust collector in the present invention, indicating how dust is blown and collected.

The fix unit 60 shown in FIG. 5 consists of a fix member 61 and a support rod 62 laterally fixed, and the connect member 61 has one end tightly fixed on an upper outer section of the cylindrical wall 21 of the housing 20, and the other end fixed firmly on a wall surface or the like. The support rod 62 has its one end stably fixed with the lower outer section of the cylindrical wall 21 and the other end to contact the lower section of the wall surface. Therefore, the simple dust collector in the invention is stably installed on the ground stably with two, one upper and one lower, fulcrums.

Figure 6:
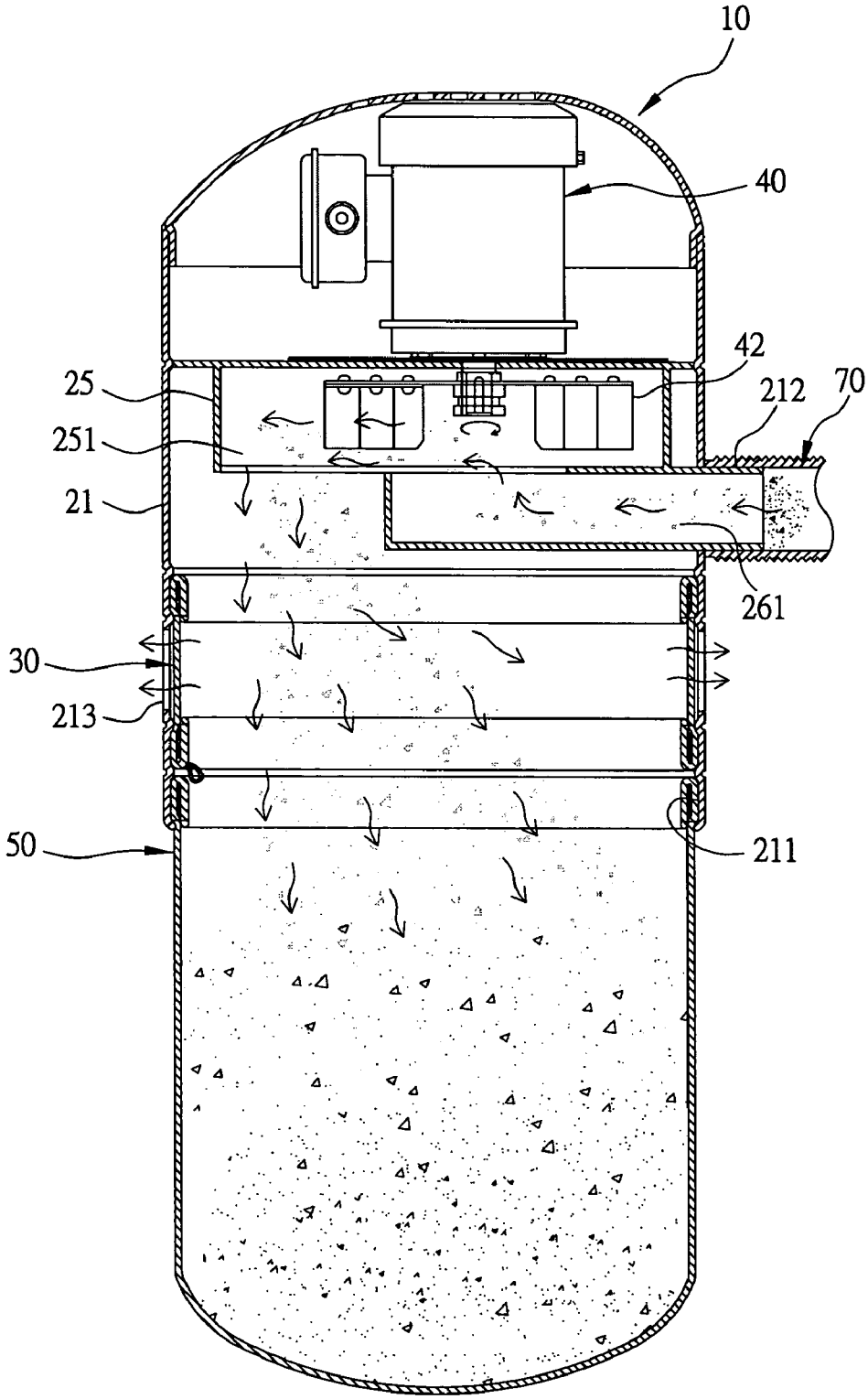

In using, as shown in FIGS. 5 and 6, the simple dust collector 10 is installed stably by means of the fix member 61 and the support rod 62 of the fix unit 60. Then the airy cloth ring 30, the dust bag 50 and the dust tube 70 are orderly assembled with the housing 20 in the way described above, and the motor 40 is powered to rotate the fan 42, which then generates wind to suck powder dust into the dust tube 70 through the tube joint 212 into the dust passageway 261, then to the side of the fan cover 25, and then Into the opening 211 of the cylindrical wall 21 and then finally falls into the dust bag 50. The air mixed with dust is filtered by the airy cloth ring 30 and then blown out of the wind outlets 23 into the exterior open air.

The simple dust collector according to the invention has the following advantages, as can be understood from the foresaid description.

1. The dust collector 10 has a small size and a lightweight, and is convenient to use.

2. It is easily installed on the ground and a vertical wall nearby, taking only a small space, especially suitable for a small factory.

3. The motor and the wind exhausting structure are built-in to be hidden in the housing, making the whole structure clean and neat and smooth, not exposing out to be smeared by dirt or moistened.

4. Its producing cost is considerably low because of the small size and the simple structure, possible to obtain economic gain.

While the preferred embodiment of the invention has been described above, it will be recognized and understood that various modifications may be made therein and the appended claims are intended to cover all such modifications that may fall within the spirit and scope of the invention.

What is claimed is:

1. A simple dust collector comprising:

A housing having a cylindrical wall, a cover sealing an upper side of said cylindrical wall, a base plate horizontally provided in an interior of said housing to separate the interior of said housing, an opening formed in a bottom side of said housing, a motor chamber formed between said base plate and said cover, a fan cover provided under a bottom of said base plate, a sucking passageway formed under said fan cover, a wind exhausting hole formed under a bottom of said fan cover, said sucking passageway having a right end communicating with a tube joint fixed with an outer surface of said cylindrical wall, a dust sucking tube connected with said tube joint, a lower section of said cylindrical wall than said wind exhausting hole provided with a plurality of wind outlets to communicate with the exterior open air:

An airy cloth ring provided to fit around elastically an inner surface of said wind outlets of said housing for air to be filtered and pass through said airy cloth ring and then flow out through said wind outlets:

A motor fixed on said base plate in said motor chamber, said motor having a shaft connected and driving a fan located in said fan cover, said fan rotated by said motor to generate wind for sucking so that dust may be blown by the wind and sucked through said sucking tube into said sucking passageway, the dust carried by centrifugal force generated by said fan to the side of said fan to be separated by said airy cloth ring and fall down through wing exhausting hole of its own weight with the air flowing through said airy cloth ring and said wind outlets and out into the exterior open air: and, A dust bag fitted elastically around said opening of said housing for collecting dust falling down through an opening of said dust bag.

2. The simple dust collector as claimed in claim 1, wherein a guide tube is provided under a proper location of said fan cover, said guide tube having its interior formed with said sucking passageway, said tube joint formed extending out from said guide tube as integral.

3. The simple dust collector as claimed in claim 1, wherein said wind outlets of said housing are formed spaced apart with preset intervals in said cylindrical wall, a first annular groove formed in an upper wall of said wind outlets, a second annular groove formed in a lower wall of said wind outlets, a third annular groove further formed in the wall below said second annular groove, said airy cloth ring shaped as an annular band and having an elastic strip respectively wrapped on an upper side and a lower side of said airy cloth ring so that said airy cloth ring may elastically be fitted stably around said first and said second annular groove of said wind outlets, a pull ring further provided at a lower section of said airy cloth ring for a user to pull at so as to pull down said airy cloth ring off said wind outlets, said dust bag having an elastic strip wrapped on an inner surface of a mouth to let said dust bag fitting elastically and stably around said third annular groove of said housing by means of said elastic strip.

4. The simple dust collector as claimed in claim 1, wherein a fix member and a support rod are respectively fixed firmly at an upper outer surface and a lower outer surface of said cylindrical wall so that said simple dust collector may be installed with a vertical wall or the like, kept quite stable with outer ends of said fix member firmly fixed with said vertical wall and with the outer end of said support rod contacting with the vertical wall.

* * * * *